United States Patent [19]

Ivanov et al.

[11] 4,371,290

[45] Feb. 1, 1983

[54] SHUTTERING FOR ESTABLISHING CONCRETE LINING OF TUNNELS

[76] Inventors: Valentin A. Ivanov, ulitsa Konstantinova, 4, kv. 25; Vladimir A. Khodosh, M.Pirogovskaya ulitsa, 27, korpus 1, kv. 11; Mikhail Y. Shenkman, Otkrytoe shosse, 24, korpus 5g, kv. 37; Vladimir L. Kirbatov, Planetnaya, 26, kv. 43, all of Moscow; Iosif D. Fishman, ulitsa Mashinostroitelei, 13, kv. 20, Yasinovataya Donetskoi oblasti, all of U.S.S.R.

[21] Appl. No.: 147,097

[22] Filed: May 7, 1980

[30] Foreign Application Priority Data

May 17, 1979 [SU] U.S.S.R. ..... 2765960

[51] Int. Cl.[3] ..... E21D 11/00

[52] U.S. Cl. ..... 405/150; 405/146

[58] Field of Search ..... 405/142, 143, 145, 146, 405/150, 288, 297, 299; 249/11

[56] References Cited

U.S. PATENT DOCUMENTS

| | | | |
|---|---|---|---|
| Re. 26,132 | 1/1967 | Cerutti | 405/150 X |
| 3,733,835 | 5/1973 | Jacobs | 405/142 |

FOREIGN PATENT DOCUMENTS

| | | | |
|---|---|---|---|
| 464703 | 9/1975 | U.S.S.R. | 405/289 |
| 699199 | 11/1979 | U.S.S.R. | 405/297 |

*Primary Examiner*—David H. Corbin
*Assistant Examiner*—Nancy J. Pistel
*Attorney, Agent, or Firm*—Fleit & Jacobson

[57] ABSTRACT

A characteristic feature of the proposed shuttering is the fact that its adjacent sections are interconnected through means preventing them from being mutually inclined in a vertical plane; said means is interposed between said sections and is made as a bar and four links mounted in pairs on pivots at the bar ends, while ends of the links are connected, through ball-and-socket joints, to the respective sections; said bar being composed of at least two members swivelling with respect to each other about a common longitudinal axis.

4 Claims, 5 Drawing Figures

SHUTTERING FOR ESTABLISHING CONCRETE LINING OF TUNNELS

Figure 1:
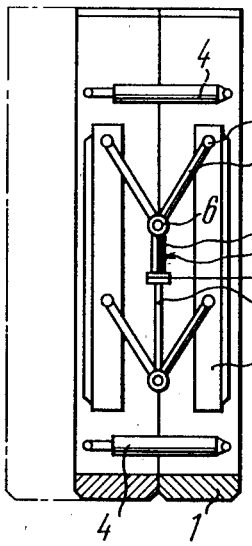
Figure 2:
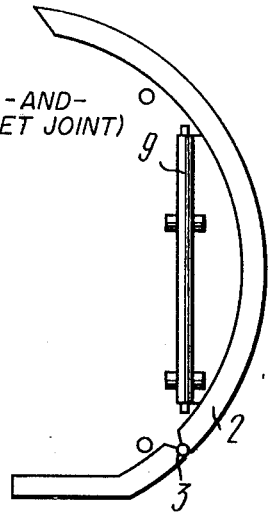

The present invention relates generally to construction of various-purpose tunnels and other underground structures, and more specifically, to shuttering for establishing concrete linings of tunnels.

The invention finds most utility when used in constructing concrete and pressed monolithic lining of tunnels.

The present-state of the art discloses a great many shuttering constructions for establishing concrete lining of tunnels.

Travelling shutterings are known in the art for establishing concrete lining of tunnels driven by the full-face method, and comprise a number of sections consisting of separate hinged members, and a special traverser mechanism comprising a self-propelled bogie adapted to traverse and set in position the hinged members.

With such a shuttering construction its sections are assembled by means of the traverser mechanism and then are bolted to one another. Then a concrete mix is fed to the space behind the shuttering and is left to set there, whereupon the shuttering is disassembled and is transferred to another place by the traverser to be reassembled there.

Also in the prior-art, sectionalized travelling shuttering is known to consist of welded tubings bolted together. The shuttering is assembled by a lever-type setter travelling along arms held to side pieces of the shuttering, and is disassembled by a setter-traverser located at the end of the workplace.

Another sectionalized traversable shuttering is known to comprise hinge-foldable sections which are transferred and assembled by a self-propelled mechanism; each section of such shuttering is made up of top and bottom pieces, the top one having two hinge-joined segments, and the bottom piece comprises a segment to which side, swing-down segments are hinge-joined. After having been erected on the worksite, the top and bottom pieces of the section are bolted together into a solid ring.

The abovesaid types of shuttering are constructionally sophisticated and involve much labour consumed during their erection and dismantling; apart from that, a special complicated and bulky mechanism is required for the separation of the shuttering sections and their traversing. Application of the known progressive and travelling shutterings involves much labour-consuming time concerned with assembling, disassembling and traversing of the sections and with a necessity to use complicated and bulky mechanisms for separating the sections from the finished lining and for their traversing.

Known in the art are travelling shutterings that can be tranversed assembled, however they have but a limited application, e.g., for constructing straight tunnel portions, and require much effort to traverse along the tunnel.

A hinge-joined travelling shuttering is known to comprise a number of sections composed of separate hinge-joined element, and a self-propelled bogie for their erection and traversing. The sections are erected and poured one-after-another in the direction of tunnel production. Once the poured lining ring has set firmly, the sections are successively folded hinged construction, and are traversed in the folded state to a next position at the tunnel face.

The shuttering of the prior art described is installed as follows: the top side elements of the sections, with their bottom supporting elements resting upon wedges and are bolted together with the adjacent sections. Each folded section is then hoisted by two pairs of pendulum hydraulic jacks, then by two pairs of horizontal screw jacks hinged to the section, and is set to a specified position. The bottom elements of the section, which is suspended on the cables of bogie-mounted winches, are permitted to descend due to their own weight. The supporting elements are wedged up and are held in place by rods through short holes drilled in the work bottom. Then, the thus-erected section is bolted to the adjacent sections. To remove the shuttering one must proceed in the following sequence: a bogie is rolled under the section to be dismantled and is held to the latter by jacks, whereupon the bolts holding the sections to the work bottom must be removed and the adjacent section, and the bottom element are separated using the help of screws and turnbuckles, after which the bottom elements are hauled by winch under the bogie platform. The top element of the section is separated by the jacks of the bogies, and the section is position into its travelling position by these jacks.

However, such type of prior art shuttering involves the use of a bulky and complicated mechanism for its separation and moment.

Another prior art shuttering for establishing concrete linings in tunnels comprises essentially a closed contour consisting of a hinge-joined a vault or wall segment and a base segment and to have a drive mechanism for separating said segments from the tunnel lining; said later mentioned mechanism comprises two shackle-joined eccentric shafts rotatably mounted at the top ends of said segments and operated by a drive. One of the eccentric shafts is mounted spatially adjustable by a wedge.

The shuttering is constituted by a number of sections, i.e., at least two of which being interconnected through hydraulic cylinders, which serve to alternately move the respective sections along the tunnel one of which is held in place by virtue of friction forces resulting from pressing of its segments upon the lining, while the other section is being traversed along the tunnel.

In order to traverse a next section, its segments are separated from the finished tunnel lining by the separating mechanism, and the travelling hydraulic cylinders are put in operation, which traverse the released section while thrusting against the stationary one.

Then, the thus-traversed section is secured to the lining, and the other section, that has served as a support for the former one, is separated from the lining and moved by the hydraulic with respect to the former section. Thus, the entire shuttering is successively traversed along the beams which with one of their ends rest on the concreted flooring, and with the other ends, on the tunnel basement.

However, the above-discussed prior art shutter may suffer from mutual inclination of its sections and even fall while in transit due to low stability, since when the shuttering has to operate in immediate conjunction with the tunneling shield, its width is much less than its height.

An essential object of the present invention is to provide means for traversing of shuttering inside a tunnel lining without mutual inclination of the sections in a vertical plane.

Another object of the present invention is to provide does a construction of shuttering that should not involve complicated mechanisms for its traversing.

One more object of the present invention is to simplify the construction of the device and render its manufacture simpler, requiring less labor, and speeding up production.

Said, and other objects, are accomplished due to the novel shuttering comprises a number of sections, each of them being a closed contour constituted by a vault segment and a basement segment hinged together, according to the invention, the adjacent sections of the shuttering are interconnected through means that prevents them from being vertically inclined with respect to each other, said means being interposed between adjacent sections and consists of a bar and four links mounted in pairs on pivots at the bar ends, while the vacant ends of said links are connected, through ball-and-socket joints, to respective sections, the bar being composed of at least two members free to swivel with respect to each other about a common longitudinal axis.

It is expedient that the links connected to the same section, be equal in length and be arranged parallel to each other.

The essence of the present invention is as follows;

The above-mentioned means comprises a vertical bar provided with pivots at its ends; each of the pivots mounts swivel links, grouped in pairs at each bar end. The outer ends of top and and bottom links are connected to adjacent sections of the shuttering so as to form two parallel cranks or arms, along with the bar and the sections, said parallel crank gears being symmetrical to the vertical bar. The device ensures that the shuttering sections remain parallel to each other while one of them travels with respect to the other along the tunnel axis but permits their mutual shifting in a vertical direction.

When the shuttering travels along a curved pathway (on curved tunnel route), the adjacent sections should turn through a horizontal angle with respect to each other. In order to provide such a turn, the ends of said links are connected to the sections of the shuttering by virtue of ball-and-socket joints.

When traversing the free section of the shuttering, i.e., the one whose cross-sectional dimensions are to be previously diminished, it is necessary for the proposed means to operate normally so that the bar is divided and comprises at least two members, a top and a bottom, interconnected so as to swivel with respect to each other about a common longitudinal axis.

The proposed invention makes it possible to traverse the sections of shuttering without distorting them with respect to each other in a vertical plane, to pass the sections along curved tunnel portions and retain their stability in the case of some obstacles encountered, i.e., such as outshots in the tunnel troughing portion, which cuts down on time spent for traversing the shuttering and thus accelerates the rate of tunneling.

Figure 3:
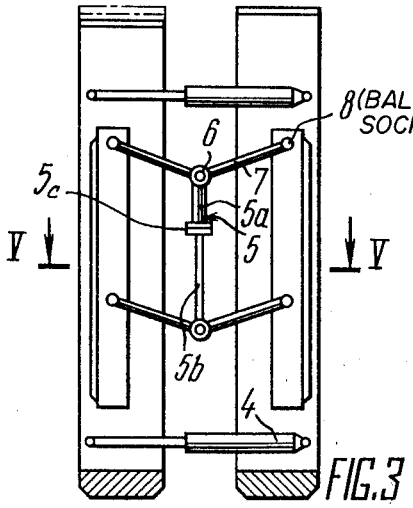
Figure 4:
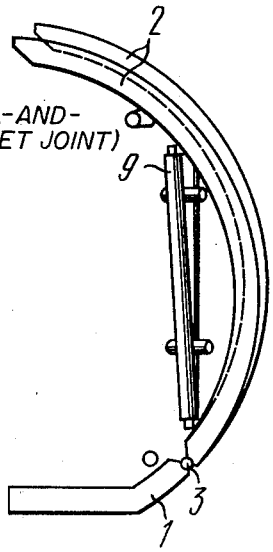
Figure 5:
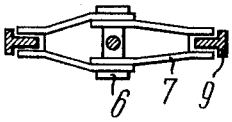

Further objects and advantages of the invention will become apparent from the following description of a preferred embodiment when taken in conjunction with the appended drawing, in which:

FIG. 5 is a horizontal section taken along line V—V in FIG. 3.

The shuttering (FIGS. 1, 2, 3, 4, 5), according to the invention, is sectionalized. Each of the sections incorporates a bottom segment 1 and two top segments 2 (only one shown). The bottom segment 1 is joined to the top segments 2 by hinges 3. Interposed between the sections are hydraulic cylinders 4. The adjacent sections of the shuttering are interconnected by means preventing them from mutual distortion in a vertical plane, said means comprising a vertical bar 5 including a top member 5*a* and a bottom member 5*b* interconnected to each other by a swivel joint 5*c* so as to swivel with respect to each other about a common longitudinal axis.

The bar 5 carries links 7 at its upper end, said links being mounted in pairs on pivots 6. the outer ends of the links 7 are connected, through bolt-and-socket joints 8, to arms 9 held to the side segments 2 of the shuttering sections. The links secured on the same sections, are equal in length and are mutually parallel.

The shuttering for establishing concrete lining of a tunnel operates as follows:

Before being traversed, one of the pair of shuttering sections is held to the concrete lining by virtue of friction, while the segments of the other section are separated from the finished lining and deflected inward. The hydraulic cylinders 4, while thrusting against the stationary fixed section, move the released section over a distance equal to the stroke of the cylinder rod. As a result, the links 7 follow the movement of the section segments and swivel both with respect to the members 5*a* and 5*b* of the bar 5 in the plane of its arrangement; and with respect to the segments 2 of the sections; thus retaining the stability of the released section being traversed or displaced. A possibility of relative swivelling of the top member 5*a* and the bottom member 5*b* of the bar 5, provides for free and unobstructed changing of the cross-sectional dimensions of the adjacent sections, which facilitates separating the segments from the finished lining, or in curved tunnel portions.

Unlike the known constructions of shuttering, the novel shuttering is much simpler. Practical application of the proposed construction makes it possible to traverse the sections of shuttering without distortion with respect to each other in a vertical plane and, their passing along curvilinear tunnel portions, and to retain the stability of the sections in the case of obstacles such as outshots on the tunnel troughing portion and to pass by said obstacles. The proposed construction cuts down time spent for traversing the shuttering and reduces manual labour.

What is claimed is:

1. A shutter assembly for facilitating production of poured, concrete linings, comprising:

a plurality of shutter sections disposed in adjacent, essentially side-by-side relation, each of said shutter sections including at least a base segment and a wall segment;

hinge means for connecting said base and said wall segments in pivotal relation with respect to each other to thereby form an assembled shutter section, and preventing means connected between two adjacent shutter sections for preventing the sections from being mutually inclined in a vertical plane and for permitting relative step-by-step movement of one assembled shutter section with respect to the other along a pouring site so that the assembled shutter assembly can negotiate curves, obstacles, and the like, said preventing means comprising a vertical bar, said bar including at least two portions relatively pivotal one-with-respect-to-the-other on a common, longitudinal axis; connecting links mounted in pairs at opposed ends of the vertical bar; and ball-and socket joints for pivotally connecting said links to the respective shutter sections so that one assembled shutter section being displaced can readily move away from an adjacent shutter section.

2. The shutter assembly as claimed in claim 1 in which said links connected to a respective one of said shutter sections are of equal length and are mutually parallel to each other.

3. A shutter assembly for supporting a concrete lining being poured inside of a tunnel comprising:

a plurality of individual assembled shutter sections, each of said assembled sections including a base segment, a wall segment, hinge means for interconnecting said base segment and said wall segment, and means for moving said segments between an erect position providing support for a lining being poured and a release position in which one of said segments is spaced from the lining;

support means connected between two adjacent assembled shutter sections for preventing the assembled sections from being mutually inclined in a vertical plane while permitting relative movement between an assembled section in an erect position and an adjacent assembled section in a release position, said support means comprising a vertically extending bar having two portions relatively pivotal with respect to each other along a common axis, connecting links having first ends mounted in pairs at opposed ends of the bar, and joint means for pivotally connecting second ends of said links to respective ones of the adjacent shutter sections so that the assembled section in the release position is movable away from the section in the erect position; and means interconnected between adjacent assembled sections for moving adjacent assembled sections towards and away from each other.

4. The shutter assembly as claimed in claim 3 in which said links connected to a respective one of said shutter sections are of equal length and are mutually parallel to each other.

* * * * *